US006772921B2

(12) United States Patent
Kendall et al.

(10) Patent No.: US 6,772,921 B2
(45) Date of Patent: Aug. 10, 2004

(54) REFRACTORY NOZZLE

(75) Inventors: Martin Kendall, Hasselt (BE); Hilaire Vaes, Zonhoven (BE); Jos Swennen, Meeuwen (BE)

(73) Assignee: Heraeus Electro-Nite International N.V., Houthalen (BE)

( * ) Notice: Subject to any disclaimer, the term of this patent is extended or adjusted under 35 U.S.C. 154(b) by 91 days.

(21) Appl. No.: 10/191,903

(22) Filed: Jul. 8, 2002

(65) Prior Publication Data

US 2003/0011112 A1 Jan. 16, 2003

(30) Foreign Application Priority Data

Jul. 10, 2001 (DE) ..... 101 32 575

(51) Int. Cl.[7] ..... B22D 35/06
(52) U.S. Cl. ..... 222/593; 266/236
(58) Field of Search ..... 222/591, 593; 266/236

(56) References Cited

U.S. PATENT DOCUMENTS 3,722,821 A 3/1973 Jaeger et al.
4,244,796 A * 1/1981 Rummel et al. ..... 205/741
4,850,572 A 7/1989 Cure

FOREIGN PATENT DOCUMENTS

| | | | |
|---|---|---|---|
| EP | 0491040 | * | 3/1995 |
| JP | 57075263 | | 5/1982 |
| JP | 57075265 | | 5/1982 |
| JP | 57075266 | | 5/1982 |
| JP | 57085659 | A | 5/1982 |
| JP | 58013449 | | 1/1983 |
| JP | 62104655 | A | 5/1987 |
| JP | 63056349 | | 3/1988 |

* cited by examiner

*Primary Examiner*—Scott Kastler
(74) *Attorney, Agent, or Firm*—Akin Gump Strauss Hauer & Feld LLP

(57) ABSTRACT

A refractory nozzle is provided for arrangement in the wall of metallurgic vessels, especially for steel melts. The nozzle has a passage opening with an upper end and a bottom end, an inside wall of a solid electrolyte material enclosing the passage opening. At least one electrode is arranged on an outer side of the solid electrolyte material facing away from the passage opening and having connecting lines leading electro-conductively therefrom. Thermal insulating material at least partially encloses the outer side of the solid electrolyte material and the electrode. The at least one electrode is essentially made of a metal which has a melting point of at least about 1400° C. and/or of at least one of its oxides.

23 Claims, 1 Drawing Sheet

REFRACTORY NOZZLE

BACKGROUND OF THE INVENTION

The invention concerns The refractory nozzle for arrangement in the wall of metallurgic vessels, especially for steel melts, comprising a passage opening having an upper and a bottom end, an inside wall of a solid electrolyte material enclosing the sides of the passageway opening. The nozzle has at least one electrode having connecting lines arranged electro-conductively at the outer side of the solid electrolyte material facing away from the passage opening, and has a thermally insulating material at least partially enclosing the outer side of the solid electrolyte material and the electrode.

Such a nozzle is known from U.S. Pat. No. 4,850,572. This patent describes an electrochemical method to prevent the deposition on the surface of the inside wall of the nozzle of material flowing through the nozzle.

From Japanese published patent application (kokai) JP 62-104655 A another nozzle arrangement is known, wherein the inner wall of the passage opening comprises a solid electrolyte layer, which is contacted by an outer electrode made of graphite. This is surrounded by an insulating material. A similar nozzle is known from Japanese published patent application (kokai) JP 57-85659 A.

Furthermore, it is known to heat refractory nozzles for molten metal. In U.S. Pat. No. 3,722,821 it is disclosed that a resistance heater is arranged around the inner wall of a nozzle with the purpose to counteract thermo-mechanical tensions and to prevent the solidification on the walls of the nozzle of material flowing through.

BRIEF SUMMARY OF THE INVENTION

It is an object of this invention to make The refractory nozzle that is an improvement over known solutions and provides a highly reliable nozzle.

According to the invention, this object is achieved by having the at least one electrode made essentially of a metal and/or of an oxide thereof and having a melting point of at least about 1400° C. Such electrodes are stable, so that a nozzle with such an arrangement is very reliable, stable and low cost. It is especially advantageous if the at least one electrode is made substantially from steel, chromium or $Cr_2O$.

It is advantageous to have a chromium layer at least partially arranged in between the solid electrolyte material and the electrode, wherein this layer preferably has a thickness of approximately 50 $\mu$m. One oxide of the metal of the electrode should have a conductivity of at least about $10^{-2}$ $\Omega^{-1}$ $cm^{-1}$ at a temperature of about 1400° C. It is difficult to use the known copper electrodes to contact the appropriate solid electrolyte material, and the known graphite electrode material is easily oxidized to carbon monoxide or carbon dioxide, which could result in deterioration of the nozzle. Moreover, this problem is solved by the use of chromium, because the oxidation of this material is harmless, and $Cr_2O_3$ is also electrically conductive. The arrangement has a low electrical resistance over a long period of time. $Cr_2O_3$ can also be mixed with zirconia.

It is also useful to have a metal inlay, especially a wire mesh, arranged on the side of the electrode facing away from the solid electrolyte material. It is preferred that at least two electrodes be provided one after the other in axial direction of the passage opening and that the electrodes surround the solid electrolyte material in annular, tubular or spiral form.

It is another advantage to have an electrically insulating material arranged between the ends of the passage opening and the at least one electrode. The insulating material of the refractory nozzle can be, for example, one or more materials selected from the group consisting of alumina, zirconia and mullite, particularly zirconia mullite having approximately 37 weight % zirconia and 63 weight % mullite.

The insulating material is bordered at its upper end by a preferably sintered ring of zirconia mullite, which encloses the solid electrolyte material. The ring of zirconia mullite can be arranged at the top end of the passage opening, and a cement can be arranged between the ring of zirconia mullite and the solid electrolyte material. The cement can be based on aluminum oxide, for example. It is advantageous to use a cement with a higher heat expansion coefficient than the ring of zirconia mullite and/or the solid electrolyte material, in order to create a tension in the direction of the center of the nozzle during the heating, and thus improve the strength of the device. In this case, the cement acts as a fastener ring that increases the strength of the device.

It is advantageous to have a heater, preferably a resistance heater, at least partially surrounding the outside of the solid electrolyte material, and enclosing the electrodes. The heater enables the preheating of the nozzle, to prevent tensions and deterioration of the material because of rapid temperature change. The heater is preferably formed in an annular, tubular or spiral manner on the outside of the solid electrolyte material, preferably within the thermal insulation material. The heater can be made of carbon or graphite; from a high melting point metal, especially molybdenum; from a carbide, especially silicon carbide; or from an oxide, especially $Cr_2O_3$. Zirconia is preferably used as a solid electrolyte material. It is of advantage that this solid electrolyte material of the inner wall have a density of more than about 5.2 g/$cm^3$, a silica content of less than about 1.5 weight %, and that it preferably be sintered.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings:

The sole FIGURE is a sectional view through The refractory nozzle according to the invention.

DETAILED DESCRIPTION OF THE INVENTION

Figure 1:
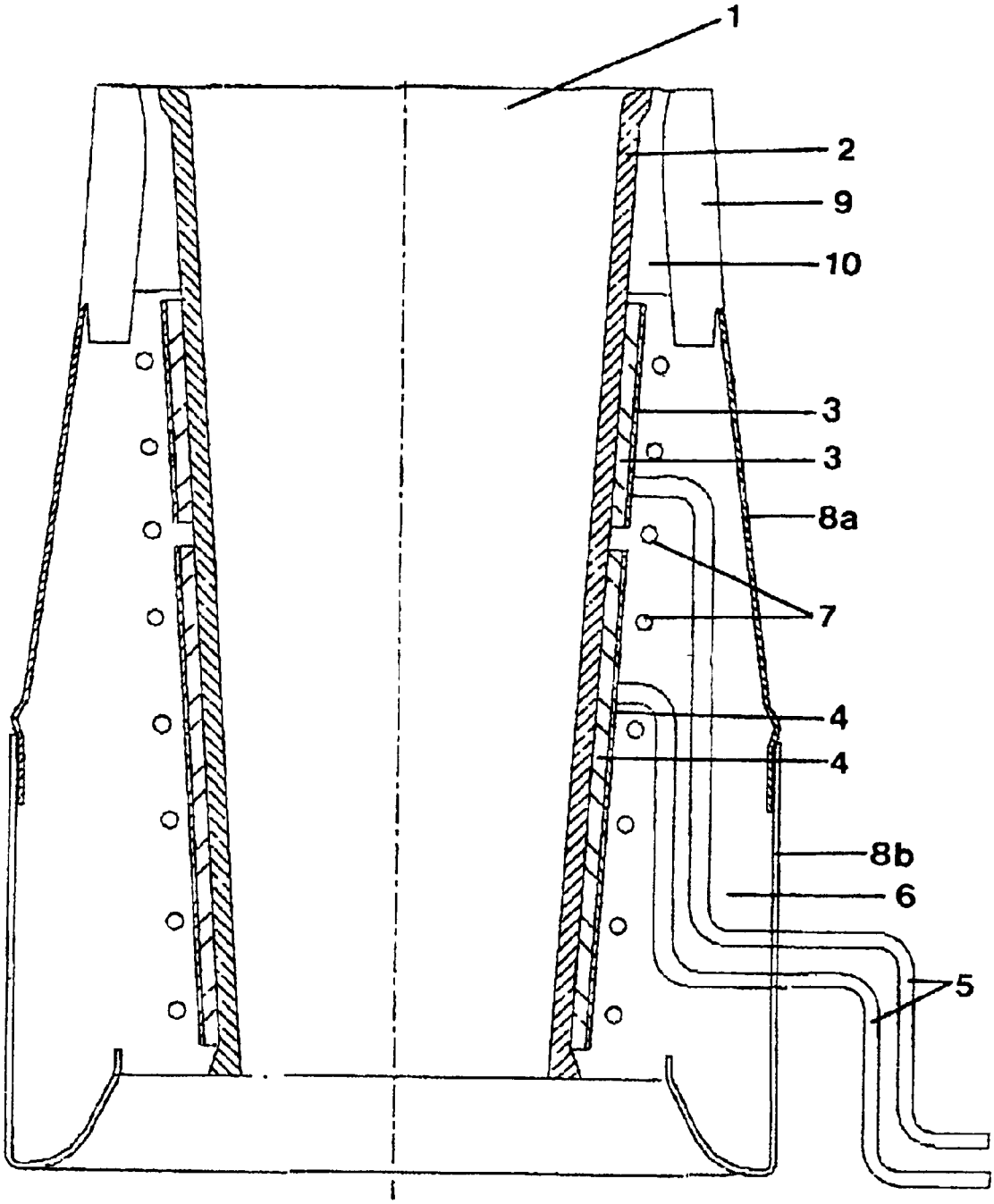

The nozzle has a passage opening 1 having an inside wall 2 made of zirconia. The diameter of the passage opening 1 increases continuously towards the top opening of the passage 1. Two annular electrodes 3, 4 are arranged one above the other on the outer side of the zirconia. Between the inside wall 2 and the electrodes 3, 4 there are provided on the solid electrolyte material at least partially chromium layers 3', 4' having a thickness of approximately 50 $\mu$m. The electrodes 3, 4 or the chromium layers 3', 4' can be made of chromium powder. The electrodes 3, 4 can also be made of steel. The material of chromium layers 3', 4' can be mixed with zirconia and should be compressed. Connecting lines or contacting electrodes 5 extend outwards from electrodes 3, 4. The electrodes are surrounded by an electrically insulating material 6, namely by zirconia mullite, in which a heater 7 is embedded. The outer surface of the nozzle is surrounded by a metal casing 8. This is made from a top part 8*a* and a bottom part 8*b*. A ring 9 of zirconia mullite on the top region of the top part 8*a* functions as an outer closure of the nozzle. A cement 10 based of aluminum oxide is arranged in between the ring 9 of zirconia mullite and the inside wall 2 of zirconia.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A refractory nozzle for arrangement in a wall of a metallurgical vessel, especially for steel melts, comprising a passage opening (1) having an upper end and a lower end, an inside wall (2) of solid electrolyte material surrounding the passage opening, at least one electrode (3, 4) arranged on an outer side of the solid electrolyte material facing away from the passage opening, the at least one electrode (3, 4) having connecting lines (5) leading electro-conductively therefrom, a chromium layer (3', 4') provided at least partially on the solid electrolyte material between the inside wall (2) and the at least one electrode (3,4), and a thermal insulating material (6) at least partially enclosing the outer side of the solid electrolyte material and the at least one electrode, wherein the at least one electrode (3, 4) substantially comprises a metal and/or a metal oxide having a melting point of at least about 1400° C.

2. The refractory nozzle according to claim 1, wherein the at least one electrode (3, 4) substantially comprises a material selected from the group consisting of steel, chromium and a chromium oxide.

3. The refractory nozzle according to claim 1, wherein the chromium layer has a thickness of approximately 50 $\mu$m.

4. The refractory nozzle according to claim 1, wherein a metallic enclosure is provided on a side of the electrode (3, 4) facing away from the solid electrolyte material.

5. The refractory nozzle according to claim 4, wherein the metallic enclosure comprises a wire mesh.

6. The refractory nozzle according to claim 1, wherein at least two electrodes (3, 4) are provided on above the other in an axial direction of the passage opening (1).

7. The refractory nozzle according to claim 1, wherein the at least one electrode (3, 4) surrounds the solid electrolyte material in annular, tubular or spiral form.

8. The refractory nozzle according to claim 1, wherein at least one electrically insulating material (6) is arranged between the ends of the passage opening (1) and the at least one electrode (3, 4).

9. The refractory nozzle according to claim 8, wherein the insulating material (6) is selected from the group consisting of alumina, zirconia and mullite.

10. The refractory nozzle according to claim 9, wherein the insulating material (6) composes a mixture of zirconium dioxide mullite comprising about 37 weight % of zirconium dioxide and about 63 weight % of mullite.

11. A refractory nozzle for arrangement in a wall of a metallurgical vessel, especially for steel melts, comprising a passage opening (1) having an upper end and a lower end, an inside wall (2) of solid electrolyte material surrounding the passage opening, at least one electrode (3,4) arranged on an outer side of the solid electrolyte material facing away from the passage opening, the at least one electrode (3,4) having connecting lines (5) leading electro-conductively therefrom, and a thermal and electrically insulating material (6) arranged between the ends of the passage opening (1) and the at least one electrode (3,4) and at least partially enclosing the outer side of the solid electrolyte material and the at least one electrode, wherein the insulating material (6) is bordered on its upper end by a sintered ring (9) of zirconium dioxide mullite which encloses th solid electrolyte material, and wherein the at least one electrode (3,4) substantially comprises a metal and/or a metal oxide having a melting point of at least about 1400° C.

12. The refractory nozzle according to claim 11, wherein the ring (9) of zirconium dioxide mullite is arranged at the upper end of the passage opening (1).

13. The refractory nozzle according to claim 11, wherein a cement (10) is arranged between he ring (9) of zirconium dioxide mullite and the solid electrolyte material (2).

14. The refractory nozzle according to claim 13, wherein the cement (10) is based on aluminum oxide.

15. The refractory nozzle according to claim 13, wherein the cement (10) has an absolute thermal expansion higher than that of the ring (9) of zirconium dioxide mullite and/or the solid electrolyte material (2).

16. The refractory nozzle according to claim 1, wherein the outer side of the solid electrolyte material (2) is at least partially surrounded by a heater (7).

17. The refractory nozzle according to claim 16, wherein the heater (7) is a resistance heater which surround the electrodes (3, 4).

18. The refractory nozzle according to claim 16, wherein the heater (7) is arranged around the outer side of th solid electrolyte material (2) in an annular, tubular or spiral form.

19. The refractory nozzle according to claim 16, wherein the heater (7) is arranged in the thermal insulating material (6).

20. The refractory nozzle according to claim 16, wherein the heater (7) comprises a material selected from he group consisting of carbon, a high-melting metal, a carbide, an oxide, and mixtures and alloys of at least two of these materials.

21. The refractory nozzle according to claim 20, wherein the heater (7) comprises a material selected from he group consisting graphite, molybdenum, silicone carbide, $Cr_2O_3$, and mixtures and alloys of at least two of these materials

22. The refractory nozzle according to claim 1, wherein the solid electrolyte material (2) comprises zirconium dioxide.

23. The refractory nozzle according to claim 22, wherein the solid electrolyte material (2) has a density of more than about 5.2 g/cm$^3$, a silica content of less than about 1.5 weight %, and the material (2) is sintered.

* * * * *